US007628393B2

(12) United States Patent
Mitsuya et al.

(10) Patent No.: US 7,628,393 B2
(45) Date of Patent: Dec. 8, 2009

(54) DEVICE AND METHOD FOR TAKING OUT SHEETS

(75) Inventors: Yusuke Mitsuya, Yokohama (JP); Tetsuo Watanabe, Machida (JP); Naruaki Hiramitsu, Kawasaki (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 259 days.

(21) Appl. No.: 11/723,839

(22) Filed: Mar. 22, 2007

(65) Prior Publication Data

US 2007/0222137 A1 Sep. 27, 2007

(30) Foreign Application Priority Data

Mar. 24, 2006 (JP) ..... 2006-082036
Sep. 8, 2006 (JP) ..... 2006-244460

(51) Int. Cl.
*B65H 5/00* (2006.01)

(52) U.S. Cl. ..... 271/10.01; 271/10.09; 271/122; 271/125

(58) Field of Classification Search ..... 271/10.01, 271/10.09, 10.11, 122, 125
See application file for complete search history.

(56) References Cited

U.S. PATENT DOCUMENTS 4,018,434 A 4/1977 Mitchell et al.
6,554,275 B1 * 4/2003 Tranquilla ..... 271/259
7,419,156 B2 * 9/2008 Mitsuya et al. ..... 271/262
7,451,975 B2 * 11/2008 Cook et al. ..... 271/117

FOREIGN PATENT DOCUMENTS

| | | |
|---|---|---|
| EP | 0 525 582 | 2/1993 |
| EP | 0 992 443 | 4/2000 |
| JP | 2003-341860 | 12/2003 |
| JP | 2005-330065 | 12/2005 |
| JP | 2006-021917 | 1/2006 |

OTHER PUBLICATIONS

Korean Office Action dated Mar. 27, 2008 for Appln. No. 10-2007-28018.
European Search Report dated Jun. 24, 2009 for Appln. No. 07005035.6-2314.

* cited by examiner

*Primary Examiner*—David H Bollinger
(74) *Attorney, Agent, or Firm*—Pillsbury Winthrop Shaw Pittman, LLP

(57) ABSTRACT

A sheet takeout device includes a takeout belt brought into contact with a sheet set in a takeout position to generate negative pressure to adsorb the sheet, and traveled in a direction of an arrow T, and a separation roller which separates second and following sheets associatively taken out with the sheet. Triggered by detection of its leading end at a second sensor, an opposite-direction separation force is applied to the sheet to be conveyed via the separation roller.

26 Claims, 12 Drawing Sheets

DEVICE AND METHOD FOR TAKING OUT SHEETS

CROSS-REFERENCE TO RELATED APPLICATIONS

This application is based upon and claims the benefit of priority from prior Japanese Patent Applications No. 2006-082036, filed Mar. 24, 2006; and No. 2006-244460, filed Sep. 8, 2006, the entire contents of both of which are incorporated herein by reference.

BACKGROUND OF THE INVENTION

1. Field of the Invention

The present invention relates to a device and a method for taking out a plurality of stacked sheets one by one while they are separated from one another.

2. Description of the Related Art

Conventionally, as a sheet takeout device of this type, there has been known a device which feeds a plurality of sheets in a stacked state, presses these sheets to a takeout roller in a piling up direction, and rotates the takeout roller to take out sheets brought into contact with the roller one by one to a conveying path. To prevent the taking-out of the stacked sheets, this device includes a feed roller rotated in a forward direction and a separation roller for applying a separation force of an opposite direction to sandwich the conveying path (e.g., see Jpn. Pat. Appln. KOKAI Publication No. 2003-341860).

The separation roller is associatively rotated in a conveying direction when one sheet is taken out to pass through a nip between the separation and feed rollers, and rotated in a direction reverse to the conveying direction when two sheets are taken out in a stacked state to pass through the nip. Accordingly, the sheets taken out in the stacked state can be separated from one another to be conveyed one by one.

However, in the device of this type, when a certain separation force is applied to all the sheets under the same conditions, various problems occur. For example, when a separation force in an opposite direction is applied while a conveying force is applied to thin and inflexible sheets in a forward direction, the sheets may be bent or cut. When a separation force is applied to a thin sealed letter made of vinyl, the letter may be destroyed because of interaction with the feed roller.

BRIEF SUMMARY OF THE INVENTION

It is an object of the present invention to provide a device and a method for taking out sheets, capable of surely and stably separating sheets in a stacked state to take them out.

For the achievement of the above object, a sheet takeout device according to an embodiment of the present invention comprises a takeout section rotated in contact with a sheet to take out the sheet in a surface direction; a conveying section rotated while holding the sheet taken out by the takeout section to further convey the sheet; and a separation section disposed on a side opposite to the takeout section across a conveying path between the takeout section and the conveying section to apply an opposite-direction separation force to second and following sheets associatively taken out with the sheet taken out by the takeout section, after the sheet taken out by the takeout section is transferred to the conveying section.

A sheet takeout device according to another embodiment of the present invention comprises an insertion section which inserts a plurality of sheets in a stacked manner; a feed section which moves the sheets inserted via the insertion section in a stacking direction to feed a leading-end sheet of a moving direction to feed the sheet to a takeout position; a takeout section brought into contact with the sheet fed to the takeout position by the feed section, and rotated in a first direction substantially orthogonal to the stacking direction to take out the sheet in the first direction; a conveying diction which receives the sheet taken out by the takeout section on a downstream side of the first direction of the takeout section, and holds the sheet to further convey the sheet in the first direction; a separation section which applies a separation force of a second direction reverse to the first direction to the sheet taken out in the first direction by the takeout section from a side opposite to the side contacted by the takeout section to separate second and following sheets associatively taken out with the sheet; a detection section which detects the holding of the sheet taken out by the takeout section in the conveying section; and a control section which controls the separation section to apply the separation force after the detection section detects the holding of the sheet taken out by the takeout section in the conveying section.

A sheet takeout method according to still another embodiment of the present invention comprises a takeout step of taking out stacked sheets one by one to a conveying path; a conveying step of holding the sheets taken out to the conveying path to further convey the sheets; and a separation step of applying an opposite-direction separation force to second and following sheets associatively taken out with the sheet taken out in the takeout step, after the sheet taken out in the takeout step is transferred to the conveying step.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

The preferred embodiments of the present invention will be described below in detail with reference to the accompanying drawings.

Figure 1:
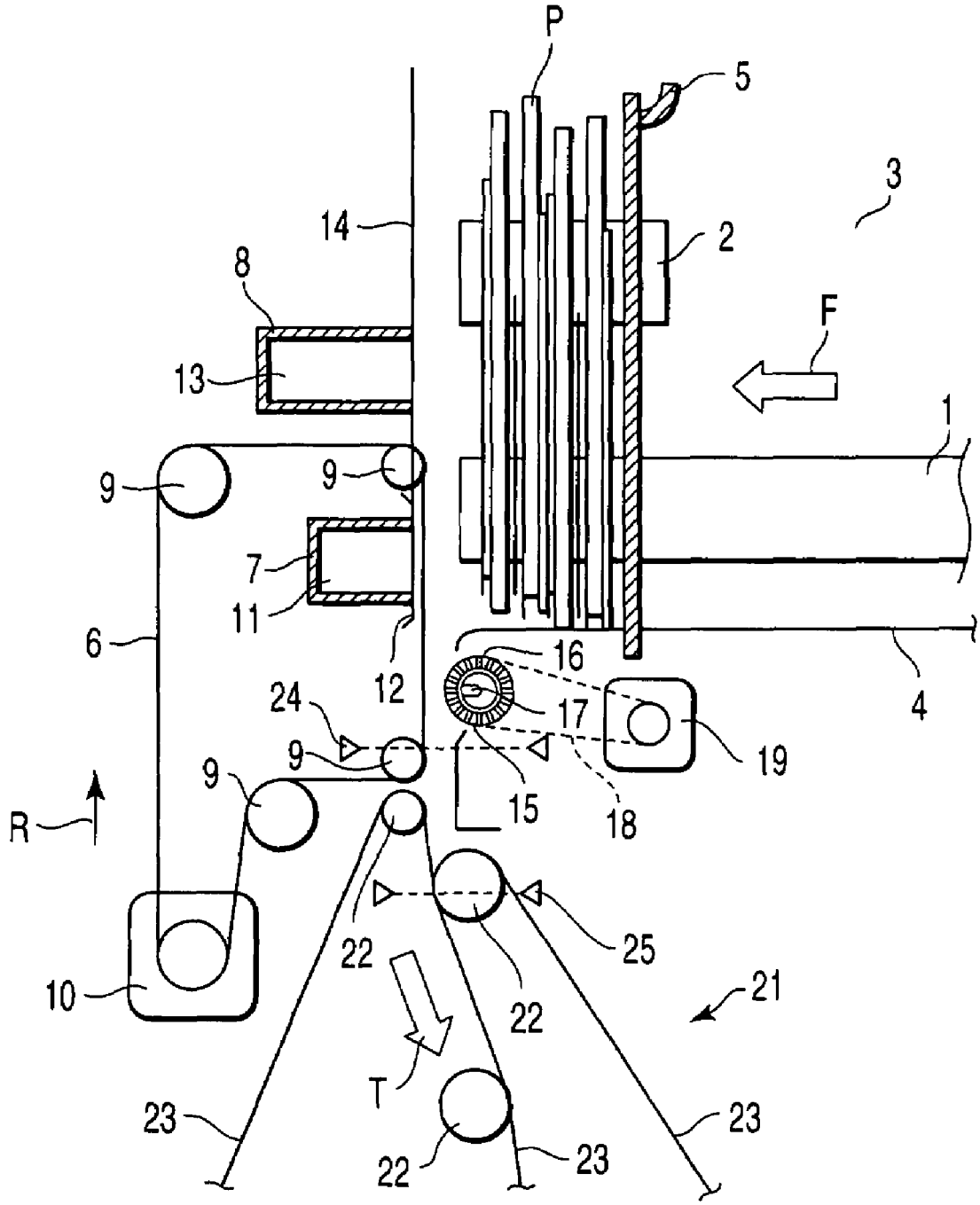
FIG. 1 is a plan diagram a schematic structure of a sheet takeout device according to a first embodiment of the present invention.

FIG. 1 is a plan diagram of a sheet takeout device (simply takeout device hereinafter) according to a first embodiment of the present invention seen from above. For example, this takeout device functions to feed a plurality of mail items en bloc, to separate the mail items to take them out one by one to a conveying path, and to convey them to a processing section of a subsequent stage (not shown).

This takeout device includes a substantially horizontal mounting base 3 (insertion section) for mounting a plurality of sheets P upright in a stacked state. The mounting base 3 has two floor belts 1, 2 arranged to extend in parallel and in a stacking direction (direction of an arrow F shown) of the sheets P. The long first floor belt 1 is arranged on a downstream side of a takeout direction (direction of an arrow T shown) of the sheets P described below, while the short second floor belt 2 is arranged on an upstream side of the takeout direction T. The floor belts 1, 2 are independently driven by a floor motor described below.

The first floor belt 1 is exposed from a mounting surface almost over a full length of the mounting base 3 to be set, and functions so that an exposed part can be brought into contact with a bottom end of the sheets P to feed the sheets P in the arrow direction F. On the other hand, the second floor belt 2 is exposed from the mounting surface only near one end of the sheets P in the stacking direction. In other words, the first floor belt 1 is acted on the bottom end of all the sheets P mounted on the mounting base 3 to feed the sheets in the arrow direction F, while the second floor belt 2 applies a feeding force only to some sheets P near one end (left end shown) of the sheets P in the stacking direction.

The mounting base 3 additionally includes a movable backup plate 5. The backup plate 5 is simply bonded to the first floor belt 1 to move with the first floor belt 1 in the staking direction while pressing a backside (right side end shown) of the sheets P. The backup plate 5 is fixed to a rail 4 extended in the takeout belt 6.

The flow-rate suction mechanism 8 includes a chamber 13, a guide 14, a blower described below, a pipe, and the like. The flow-rate suction mechanism 8 is arranged on an upstream side of the negative-pressure adsorption mechanism 7 in the takeout direction of the sheets P, and a plurality of holes are bored in the guide 14. In other words, negative pressure is applied to the sheets P near the takeout position via the guide 14 by sucking air from the chamber 13 to draw the sheets P to the takeout position. As the takeout belt 6 is not set on a side of the flow-rate type suction mechanism 8 facing the sheets P of the takeout position, this flow-rate type suction mechanism 8 has no function of conveying the drawn sheets P.

A separation mechanism 15 (separation section) is disposed along a conveying path of the sheets P taken out in the arrow direction T from the takeout position. The separation mechanism 15 is arranged in a position slightly shifted to a side opposite to the negative-pressure type adsorption mechanism 7 and its downstream side to sandwich the conveying path extended in the arrow direction T from the takeout position. The separation mechanism 15 includes a perforated roller 16, a chamber 17, a timing belt 18, a separation motor 19, a vacuum pump described below, a pipe, and the stacking direction to slide. The first and second floor belts 1, 2 and the backup plate 5 function as feeding sections of the present invention, and feed moving-direction leading end sheets among the plurality of stacked sheets P to a takeout position.

A takeout belt 6 (takeout section), a negative-pressure type adsorption mechanism 7, and a flow-rate type suction mechanism 8 are disposed in the left end (shown) of the mounting base 3. The takeout belt 6 is set around a plurality of rollers 9, and driven in an arrow direction R (shown) by rotating a takeout motor 10. The negative-pressure type adsorption mechanism 7 located inside the endless takeout belt 6 includes a chamber 11, a guide 12, a vacuum pump described below, a pipe, and the like.

A plurality of holes are bored in the takeout belt 6. By setting negative pressure in the chamber 11, air is sucked through holes formed in parts of the guide 12, and the sheets P fed to the takeout position are adsorbed on the takeout belt 6 by negative pressure of the negative-pressure type adsorption mechanism 7. Then, the takeout belt 6 having the sheets P adsorbed thereon is driven by the takeout motor 10 to convey the sheets P of the conveying position to a takeout direction downstream side (direction of an arrow T shown). In other words, a takeout speed of the sheets P is approximately equal to a traveling speed of the like.

This separation mechanism 15 sucks the inside of the chamber 17 to apply negative pressure to the sheets P conveyed on the conveying path from a side opposite to the negative-pressure type adsorption mechanism 7 thereby adsorbing the sheets P on a peripheral surface of the perforated roller 16. The peripheral surface of the perforated roller 16 is made of a rigid body such as a metal, and functions as an adsorption roller.

The separation mechanism 15 is connected to a control section 100 (FIG. 2) which drives and controls the separation motor 19 to rotate the perforated roller 16 in both forward and backward directions at a desired rotational speed and desired rotational torque. In other words, the separation mechanism 15 can feed the sheets P adsorbed by the perforated roller 16 in a conveying direction or an opposite direction to carry out a separation operation. The separation mechanism 15 can optionally change a speed for feeding the sheets P in the arrow direction T (forward direction), a speed for returning the sheets in the opposite direction, and a separation force.

A belt conveyor mechanism 21 (conveying section) is arranged on a downstream side of the separation mechanism 15 in the arrow direction T. The belt conveyor mechanism 21 includes a plurality of rollers 22, and two conveyor belts 23 wound on the plurality of rollers 22 to be set, and receives the sheets P fed through the separation mechanism 15 in the arrow direction T to hold them, and further conveys the sheets P to the downstream side.

First and second sensors 24, 25 are arranged in the conveying path from the takeout position of one end of the mounting base 3 in the stacking direction through the belt conveyor mechanism 21. The first sensor 24 is disposed near the separation mechanism 15 and slightly on a downstream side of the perforated roller 16 in the conveying direction of the sheets P, and detects passage of a leading end and a tail end of the sheets P. The second sensor 25 functions as a detection section of the present invention, and is disposed near a sandwiching point (nip hereinafter) which the two conveyor belts 23 of the belt conveyor mechanism 21 come into contact with each other to detect passage of the leading end and the tail end of the sheets P as in the case of the first sensor 24. Transmission photoelectric sensors are used for the first and second sensors, and transmit passage information of the sheets P to the control section 100 described below.

Accordingly, the plurality of sheets P set upright in the mounting base 3 are fed in the arrow direction F to the takeout position by driving the first and second floor belts 1 and 2 and the backup plate 5. The leading-end sheet P of the feeding direction is quickly drawn to the takeout belt 6 by a suction effect of the flow-rate type suction mechanism 8, adsorbed on the takeout belt 6 by the negative-pressure adsorption mechanism 7, and taken out in its surface direction by driving the takeout motor 10.

When a second sheet P and the following sheets are associatively taken out with the taken-out sheet P, the second sheet P and the following sheets are returned in a direction reverse to the conveying direction by an adsorption/separation operation (described below) of the separation mechanism 15 to be separated from the first sheet P. The sheets P separated one by one in this manner are pulled by the belt conveyor mechanism 21 to be further conveyed to the downstream side.

Figure 2:
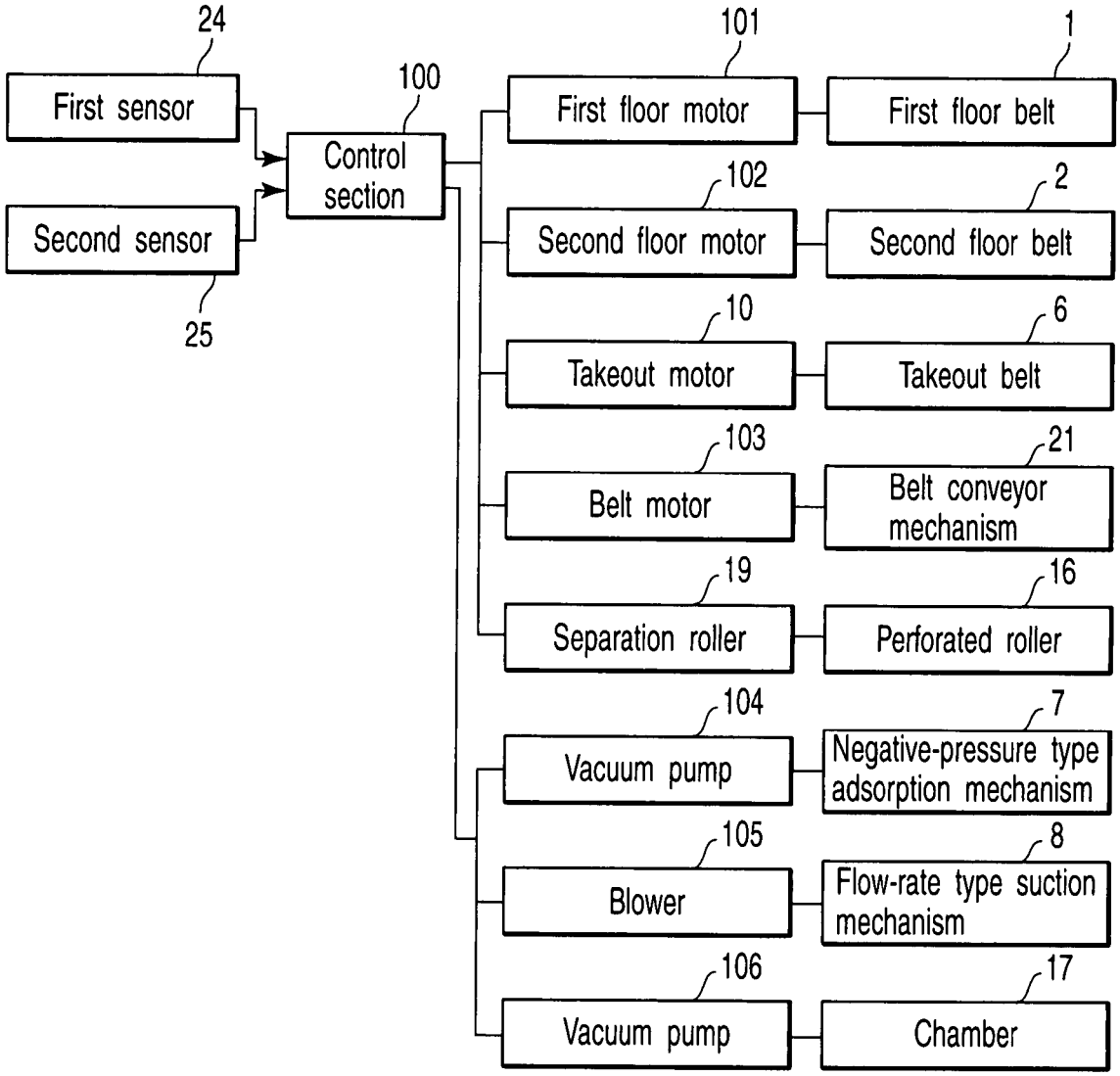
FIG. 2 is a block diagram showing a control system for controlling an operation of the sheet takeout device of FIG. 1.

FIG. 2 is a block diagram of a control system for controlling an operation of the takeout device.

The first and second sensors are connected to the control section 100 which controls the operation of the takeout device. Additionally, a first floor motor 101 for driving the first floor belt 1 and the backup plate 5 and a second motor 102 for driving the second floor belt 2 are connected to the control section 100.

The takeout motor 10 for running the takeout belt 6 in the arrow direction R (FIG. 1) at a certain speed, and a belt motor 103 for running at least one of the two conveyor belts 23 of the belt conveyor mechanism 21 in the arrow direction T (FIG. 1) at a certain speed are connected to the control section 100. The separation motor 19 for rotating the perforated roller 16 of the separation mechanism 15 forward and backward, at a variable speed, and at desired torque is connected to the control section 100.

The vacuum pump 104 of the negative-pressure adsorption mechanism 7, and the blower 105 of the flow-rate type suction mechanism 8 are connected to the control section 100. The vacuum pump 106 for evacuating the chamber 17 of the separation mechanism 15 is connected to the control section 100.

Figure 3:
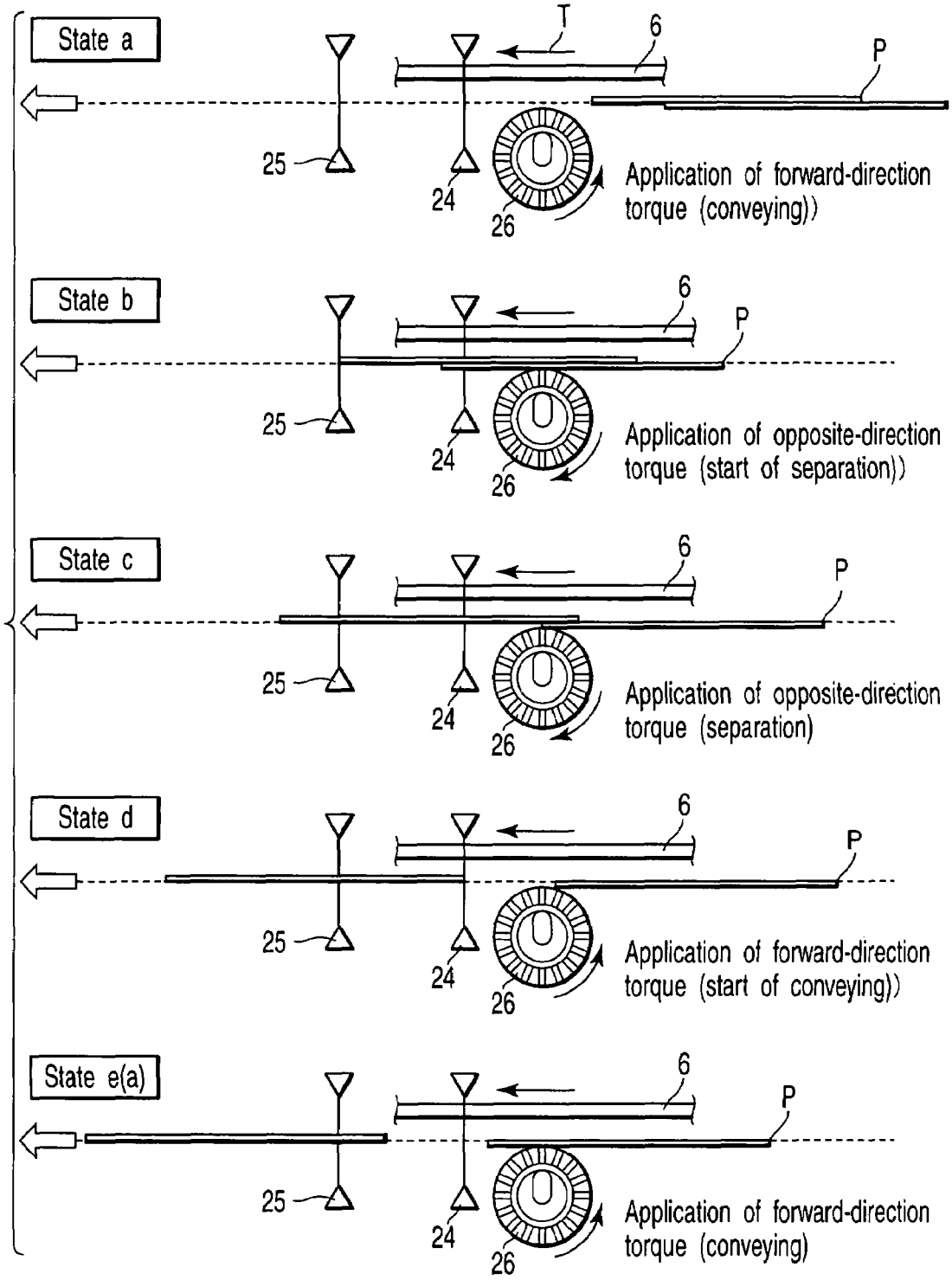
FIG. 3 is an operation explanatory diagram showing the operation of the sheet takeout device of FIG. 1.
Figure 4:
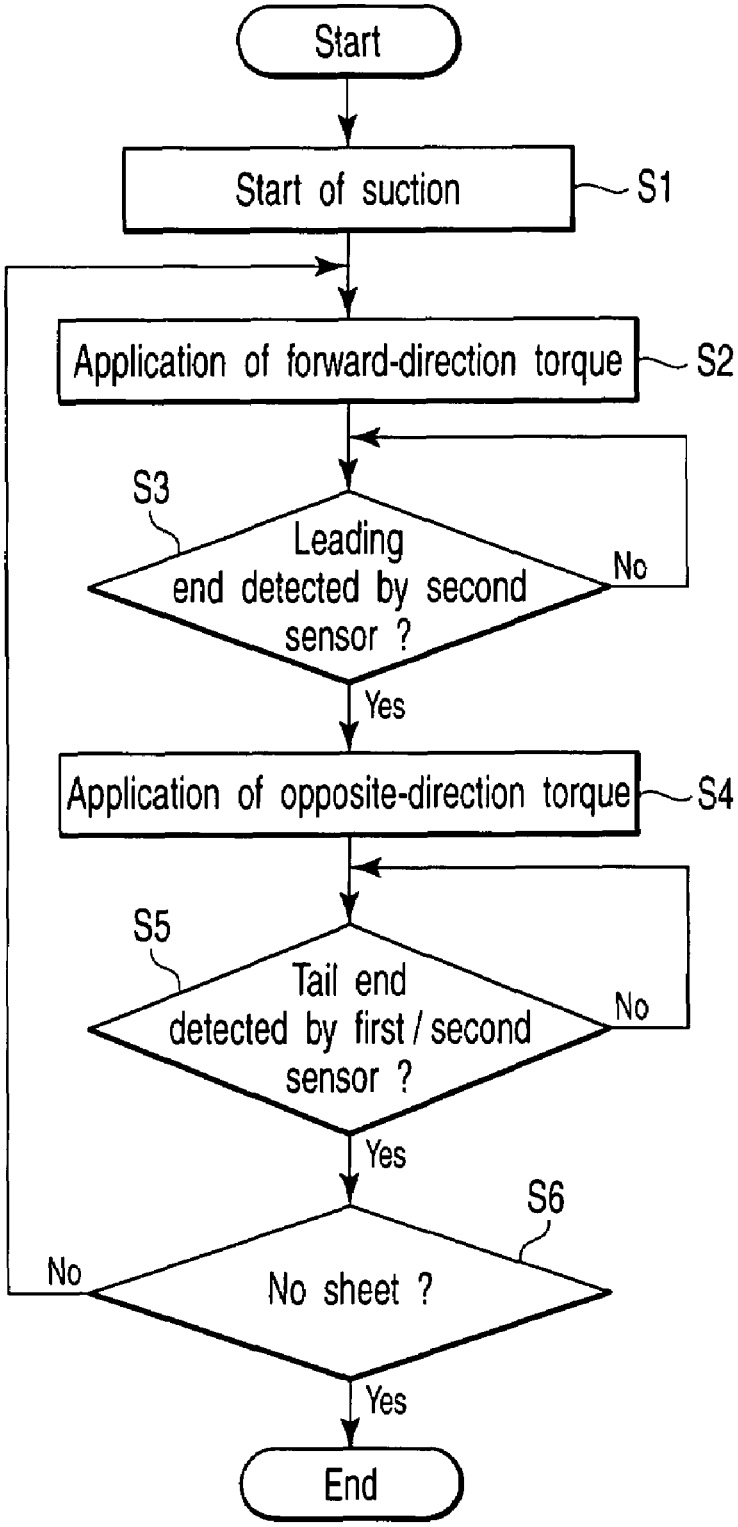
FIG. 4 is a flowchart showing the operation of the sheet takeout device of FIG. 1.
Figure 5:
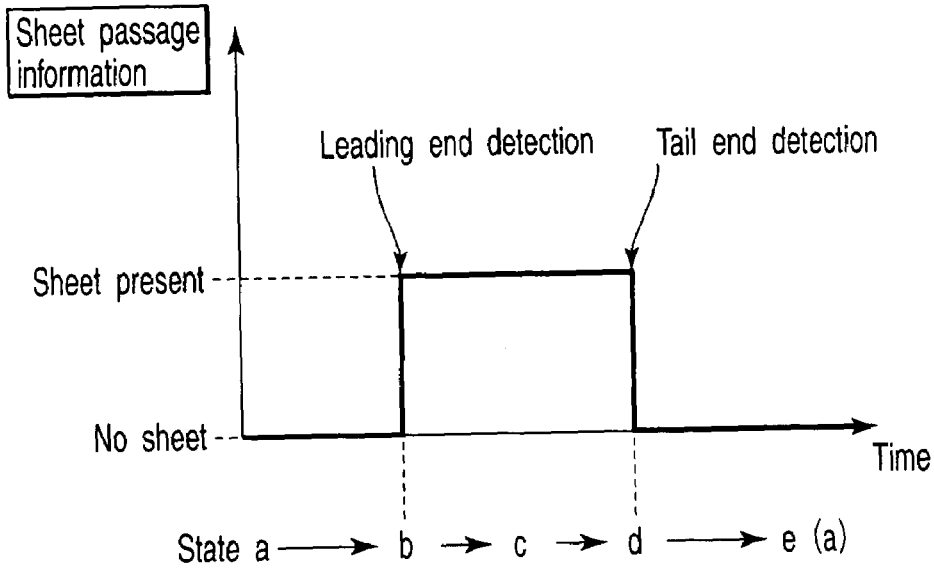
FIG. 5 is a timing chart showing sheet detection timing of first and second sensors.
Figure 6:
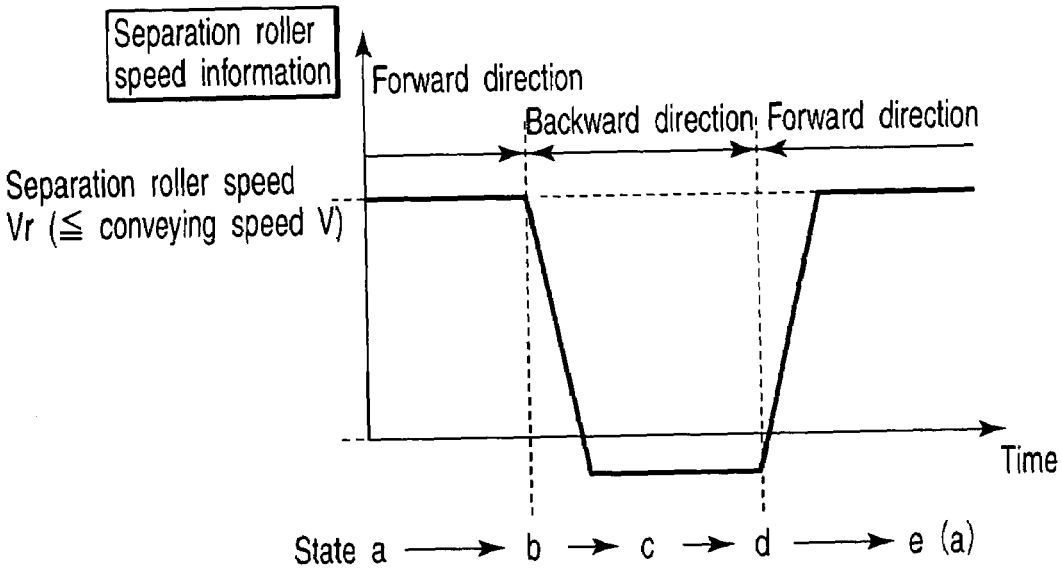
FIG. 6 is a timing chart showing operation timing of a separation roller.

The operation of the takeout device of the aforementioned structure, mainly an operation of the separation roller 26 (i.e., perforated roller 16) described below, will be described by referring to FIGS. 3 to 6. FIG. 3 is an operation explanatory diagram showing the operation of the separation roller 26, FIG. 4 is a flowchart showing the operation of the separation roller 26, FIG. 5 is a timing chart showing detection timing of the first and second sensors in states of FIG. 3, and FIG. 6 is a timing chart showing operation timing of the separation roller 26 in a state of FIG. 3. In the description below, the perforated roller 16 (roller having a peripheral surface to adsorb the sheets P) which is a rotational section of the separation mechanism 15 will be referred to as a separation roller 26.

First, as an initializing operation of the takeout device, the vacuum pump 104 is operated to generate negative pressure via the negative-pressure type adsorption mechanism 15, and the blower 105 is operated to generate an air flow via the flow-rate type suction mechanism 8. As the initializing operation, the belt motor 103 is driven to run the conveyor belts 23 of the belt conveyor mechanism 21 at a certain speed. The two floor belts 1, 2 are driven by timing for taking out the sheets P from the takeout position to always feed the leading-end sheet P of the moving direction to the takeout position.

As shown in step S1 of FIG. 4, the chamber 17 of the separation mechanism 15 is evacuated by the vacuum pump 106 to generate negative pressure in the peripheral surface of the separation roller 26. The separation motor 19 is driven to apply torque of a forward direction (arrow direction T) to the separation roller 26 (step S2), and the separation roller 26 is rotated in the feeding direction of the sheets P at a certain speed.

In this state, the takeout motor 10 is driven to run the takeout belt 6 at a certain speed, and taking-out of the sheets P is started.

At this time, the separation roller 26 applies negative pressure to the sheets P passed through the conveying path, and is rotated to feed the sheets P. As the takeout belt 6 located on a side opposite to the separation roller 26 across the conveying path travels in the conveying direction (same direction) at a certain speed, conveying force is applied from both side of the sheets P taken out in the conveying path. However, a conveying force of the separation roller 26 is set smaller than that of the takeout belt 6, and a takeout operation of the sheets P is generally dependent on an operation of the takeout belt 6.

For example, as shown in a state a of FIG. 3, when a sheet P fed to a takeout position and a next (second) sheet P are taken out in a stacked state, the first sheet P adsorbed on the takeout belt 6 is conveyed by a conveying force applied from the takeout belt 6, and the second sheet P is adsorbed on the separation roller 26 side to be conveyed by a conveying force applied from the separation roller 26. At this time, the two sheets P are peeled off from each other in opposing directions. As a conveying force is applied from the take-up belt 6 only to a stacking-direction end sheet P (i.e., first sheet) at the beginning of takeout, the sheets P taken out from the mounting base 3 are generally taken out in a state of being shifted in a venetian-blind configuration in most cases as shown in the state a of FIG. 3 even when stack-feeding occurs.

Subsequently, as shown in a state b of FIG. 3, when the second detection means 25 detects the conveying-direction leading end of the taken-out sheets P (step S3; YES), the leading end is held by the belt conveyor mechanism 21, and the first sheet P is transferred to the belt conveyor mechanism 21. In this state, as a holding force of the belt conveyor mechanism 21 is much larger than that of the takeout belt 6 for the sheets P, and a conveying speed of the belt conveyor mechanism 21 is larger than that of the takeout belt 6, the first sheet P is pulled off by a conveying force of the belt conveyor mechanism 21 to be conveyed to the downstream side.

Then, by this timing (state b), the control section 100 starts to apply torque of a reverse direction (direction for returning the sheets P to the conveying-direction upstream side) to the separation roller 26 (step S4). Then, the second sheet P to which most of the conveying force has been applied by the separation roller 26 is returned in an opposite direction by this separation force. As the two sheets P have been peeled off from each other as described above, the leading end of the second sheet P to which the separation force has been applied is ideally returned to a position facing the separation roller 26 as shown in a state c of FIG. 3.

The separation force generated by the separation force of the reverse direction is set weaker than a conveying force generated by the holding of the belt conveyor mechanism 21 of the downstream side. Accordingly, for example, when one sheet P is normally taken out in the conveying path (not shown), the separation force of the separation roller 26 never blocks conveying of the sheet P after a leading end of the sheet P is held by the belt conveyor mechanism 21. In other words, "conveying force of belt conveyor mechanism 21">"separation force of separation roller 26">"friction force (resistance force) between sheets" is established.

Specifically, if one sheet P taken out to the conveying path is relatively thin, when the sheet P is adsorbed on the takeout belt 6 to be transferred to the belt conveying mechanism 21, it is conveyed in a state of a gap present with respect to a conveying interval between the takeout belt 6 and the separation roller 26. Accordingly, the separation roller 26 to which the separation force has been applied is rotated idly in an opposite direction. On the other hand, if a thickness of the sheet P taken out to the conveying path is equal to or higher than the conveying interval, the separation roller 26 to which the separation force has been applied is rotated associatively with the sheet P.

When the first detection means 24 detects passage of a conveying-direction tail end of a first sheet P to detect formation of a gap between the first sheet P and a second sheet P after the application of the separation force in the step S4 as shown in a state d of FIG. 3 (step S5; YES), complete separation of the second sheet P from the first sheet P is judged to apply forward-direction torque to the separation roller 26 (step S2). Thus, as shown in a state e of FIG. 3, a forward-direction conveying force is applied to the second sheet P from the separation roller 26.

The operation of the steps S2 to S5 is repeated until there are no more sheets P on the mounting base 3 (step S6; YES), and the plurality of inserted sheets P are separated to be conveyed one by one.

FIG. 5 is a timing chart for detecting passage timing of the sheet P by the first and second detection means 24, 25 in association with FIG. 3, and FIG. 6 is a timing chart for a rotational speed change of the separation roller 26 in association with FIGS. 3 and 5. It can be understood from these timing charts that a separation force is applied to the separation roller 26 by the timing of detecting the leading end passage of the first sheet P by the second detection means 25 (state b of FIG. 3) and forward-direction torque is applied to the separation roller 26 by the timing of detecting the tail end passage of the first sheet P by the first detection means 24 (state d) as described above.

In the states a and b (forward rotation direction), a tangential speed Vr [m/s] of the separation roller 26 is equal to or less than a conveying speed V [m/s] of the belt conveyor mechanism 21 on a conveying downstream side. In other words, while the speed of the forward rotation direction is limited, torque of the forward rotation direction (force for rotating the separation roller 26) is not limited within a use range of the separation motor 19.

In the states b and c (reverse rotation direction), a separation force Fr generated by the separation roller 26 is set smaller than at least a conveying force Fb generated by holding of the belt conveyor mechanism 21 on the conveying downstream side. Control of a separation force and a rotational speed during reverse rotation of the separation roller 26 will be described below in detail.

Accordingly, in the states a and e, the tangential speed Vr of the separation roller 26 takes an almost constant value. On the other hand, in the states b and c, as the separation force is limited, a rotational direction of the separation roller 26 may not reach reverse rotation (tangential speed Vr<0).

Ideally, as the leading ends of the second sheet P and the following sheets are returned to the vicinity of the separation roller 26 by a separation operation, the first detection means 24 should preferably be present in the vicinity. However, as there is a possibility of formation of a gap between the first and second sheets P more on a downstream side of the first detection means 24, the tail ends are detected by the first or second detection means in the step S5 of FIG. 4. A plurality of detection means may be provided to detect the sheets P on an upstream side of the second detection means 25.

As described above, according to the present invention, when the plurality of sheets P are taken out in the state of being shifted in the sliced row fish shape and stacked to the conveying path, under the condition that the leading end of the preceding sheet P is held by the belt conveying mechanism 21, the opposite-direction separation force is applied to the second sheet P and the following sheets via the separation roller 26. Thus, sheets conveyed in the stacked state can be surely and stably separated from one another. According to the embodiment, by driving and controlling the separation roller, even when a relatively inflexible and thin sheet P or a sheet P folded into two is taken out to the conveying path, a problem of bending the sheet P into a Z shape between the negative-pressure adsorption mechanism 7 and the separation mechanism 15 can be prevented to enable a stable separation and conveying operation.

According to the embodiment, a conveying function can be provided to the separation roller 26 originally equipped with the separation function alone to assist the conveying force of the takeout belt 6 of the opposite side. Thus, for example, the device is advantageous when a relatively heavy and thick sheet P is conveyed. In other words, as the relatively thick sheet P comes into contact with the takeout belt 6 while the other surface comes into contact with the separation roller 26, a forward-direction conveying force can be applied from both sides.

Furthermore, according to the embodiment, as the mechanism of applying negative pressure from the takeout belt 6 and the separation roller 26 arranged in the positions of sandwiching the sheet P to adsorb the sheet is employed, an adsorption force is applied in the direction of peeling off the stack-fed sheets P from each other (direction vertical to the surface of the sheets P). Thus, a friction force (resistance force) between the sheets P taken out in the stacked state can be reduced to improve separation effects more.

The embodiment has been described on the presumption that the sheet P taken out from the mounting base 3 is shifted in the venetian-blind configuration as shown in the state a of FIG. 3. However, if the sheet P is shifted only slightly, or if the two sheets P are taken out with the leading ends roughly stacked as shown in a state a' of FIG. 7, the two sheets P cannot be separated when the separation roller 26 is controlled as described above. In other words, in this case, the leading ends of the two stacked sheets P enter the nip of the belt conveyor mechanism 21 substantially simultaneously, and the two sheets P are pulled off by the belt conveyor mechanism 21 to be conveyed in the stacked state. However, for the aforementioned reason, such a case is quite rare, and stack-fed sheets of no shifting during takeout may properly be rejected in subsequent processing. Another control method that takes such a rare case into consideration will be supplementarily described by referring to flowcharts of FIGS. 7 and 8.

That is, assuming such a case, the control section 100 first rotates the separation roller 26 forward at a speed (Vr) substantially equal to that of the takeout belt 6 (step S2) in a state in which negative pressure is generated in the peripheral surface of the separation roller 26 (step S1), and monitors an output of the first detection means 24 (step S3). Then, at a point of time when the first detection means 24 becomes unilluminated (step S3; YES), the control section 100 reduces a rotational speed of the separation roller 26 to half (Vr/2) (step S4). In this case, the rotational speed of the separation roller 26 is reduced only once. However, it may be gradually reduced.

Figure 7:
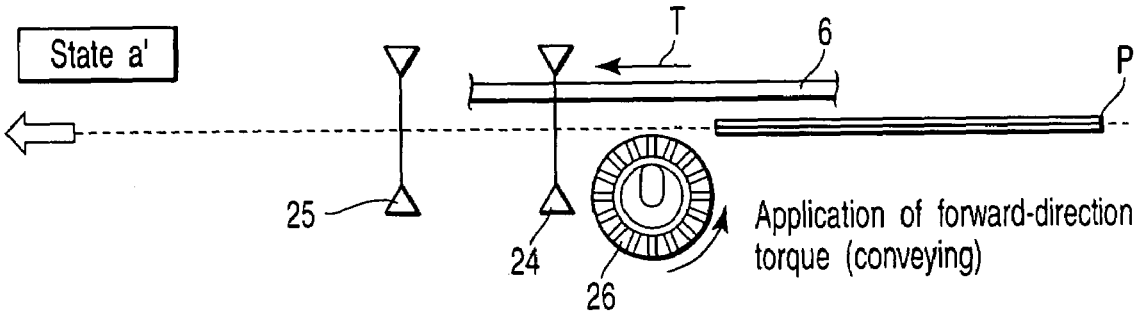
FIG. 7 is an operation explanatory diagram showing a separation operation of stack-fed sheets taken out by the sheet takeout device while their leading ends are stacked.
Figure 8:
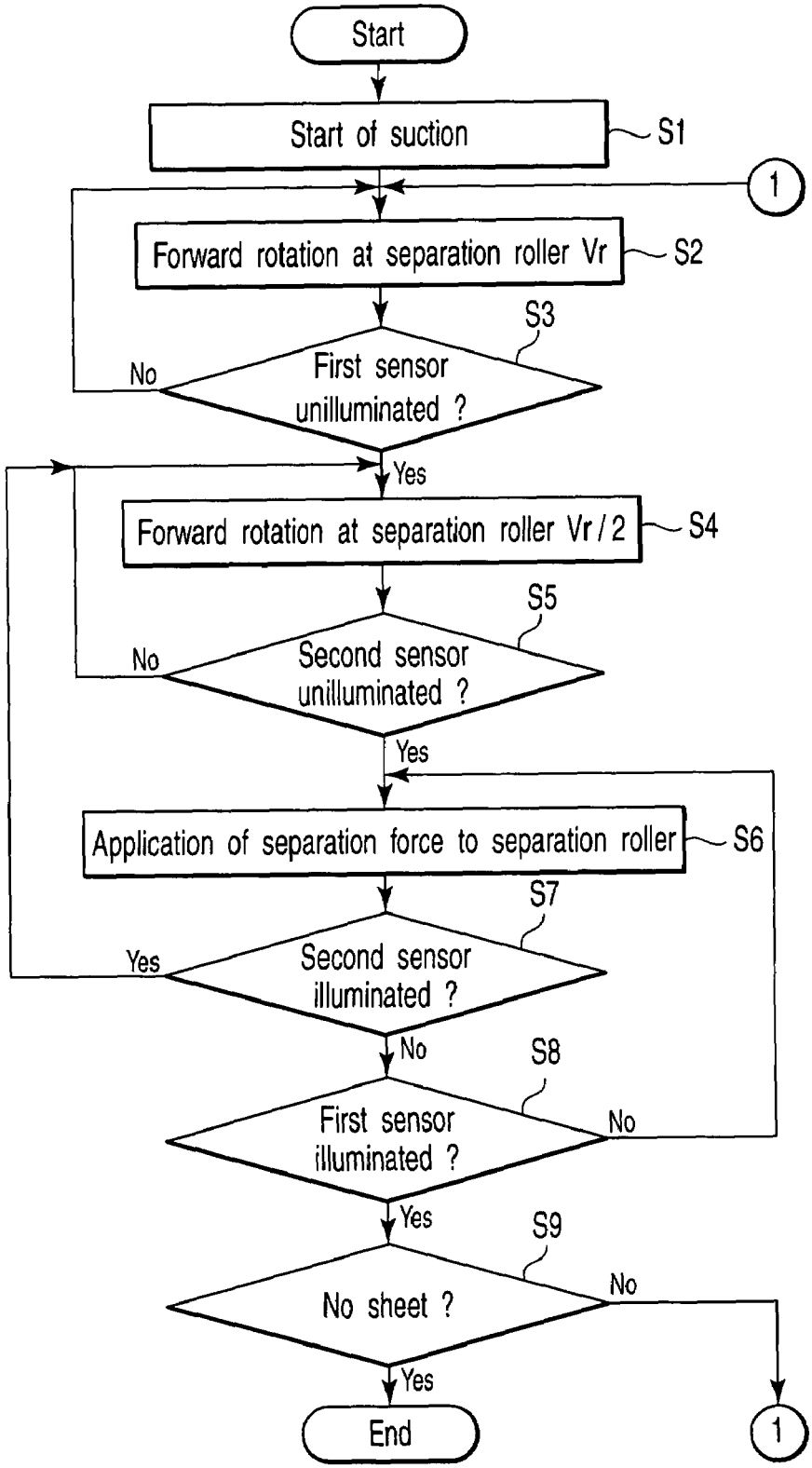
FIG. 8 is a flowchart showing a method for separating the stack-fed sheets of FIG. 7.

Accordingly, a conveying speed of the second sheet P dependent on a conveying force of the separation roller 26 is reduced, and a speed difference from the first sheet P adsorbed on the takeout belt 6 to be conveyed is formed. Thus, even in the case of stack-fed sheets taken out with the leading ends stacked as shown in FIG. 7, the sheets can be shifted in a venetian-blind configuration before the leading ends of the sheets reach the second detection means 25.

Subsequently, as in the case of the embodiment, the control section 100 monitors an output of the second detection means 25 (step S5), and applies an opposite-direction separation force to the separation roller 26 (step S6) at a point of time when the second detection means 26 becomes unilluminated (step S5; YES). Accordingly, the second sheet after are returned in an opposite direction to form a gap with the first sheet P. In this case, the gap formed between both is formed between the first and second detection means 24 and 25.

Then, the control section 100 monitors outputs of the first and second detection means 24 and 25 (steps S7, S8), and rotates the separation roller 26 forward at a half speed (Vr/2) (step S4) under the condition that a gap is detected via the second detection means 25 (step S7; YES). In this case, by setting the forward rotation speed of the separation roller 26 to half of a normal conveying speed, it is possible to further increase a gap with one preceding sheet P.

While monitoring the outputs of the first and second detection means 24, 25 in the steps S7, S8, by using detection of a gap via the first detection means 24 as a trigger (step S8; YES), under the condition that there is a next sheet P to be taken out on the mounting base 3 (step S9; NO), the control section 100 returns to the processing of the step S2 to rotate the separation roller 26 at a speed Vr. On the other hand, if it is judged in step 9 that there is no next sheet P to be taken out (step S9; YES), the control section 100 stops the takeout belt 6 to finish the process.

As described above, even when the sheets P whose leading ends are stacked are taken out, the step of shifting the sheets P in the venetian-blind configuration (step S4) can be added, and the stack-fed sheets can be surely and stably separated.

A rotation control operation of the separation roller 26 by the control section 100 when the separation force is applied by the separation roller 26 will be described below by referring to FIGS. 9 to 14.

That is, according to the embodiment, when the opposite-direction separation force is applied to the separation roller 26 to separate the stack-fed sheets as shown in the states b and c of FIG. 3, the control section 100 monitors the rotational torque and the rotational speed of the separation roller 26, and variably controls a driving force applied to the separation motor 19 in accordance with the rotational state of the separation roller 26.

A rotation control method of the separation roller 26 by the control section 100 will be described below by way of two examples.

According to the first control method, the control section 100 first provides a target value of rotational torque and a limit value of a rotational speed to a driver (not shown) of the separation motor 19. Then, the control section 100 controls rotational torque of the separation roller 26 to the target value, and a current value provided to the separation motor 19 to prevent the rotational speed of the separation roller 26 from exceeding the limit value.

Figure 9:
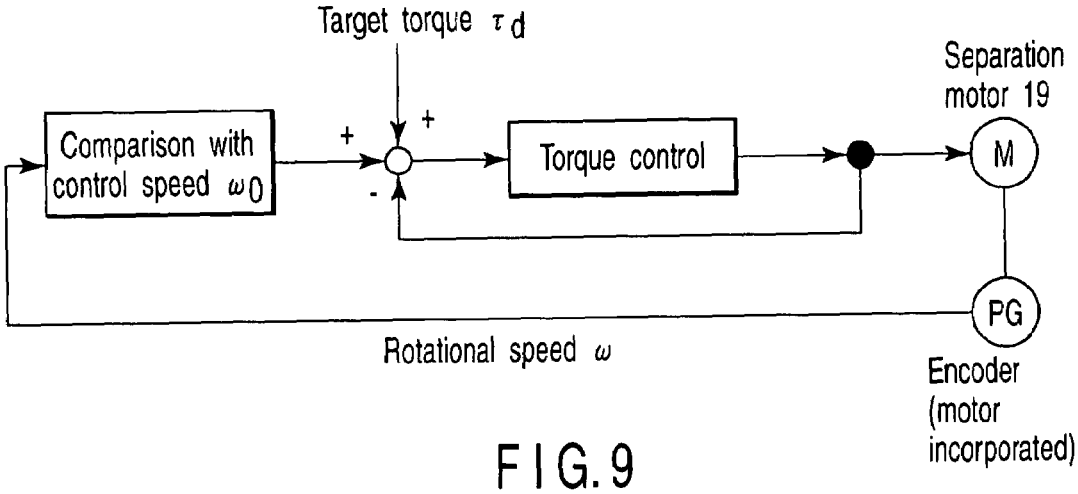
FIG. 9 is a block diagram showing a control system for controlling an operation based on a first control method of the separation roller during separation of the stack-fed sheets.
Figure 11:
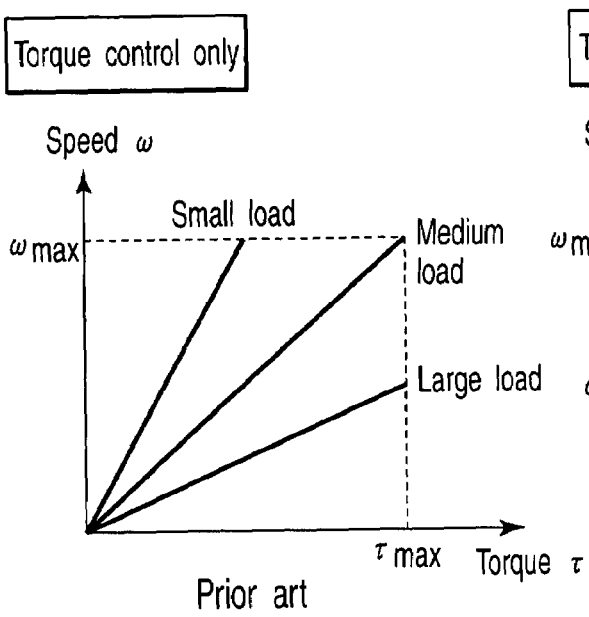
FIG. 11 is a graph showing a relation between rotational torque and a rotational speed by using a load resistance of sheets as a parameter in a conventional device having no speed limit set in a separation roller for comparison.
Figure 10:
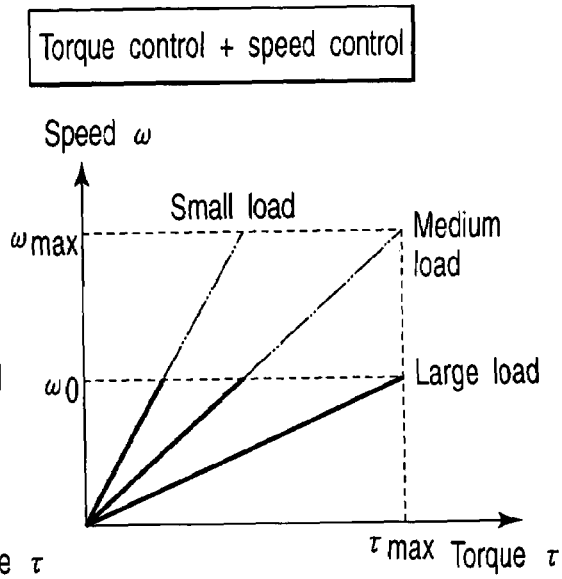
FIG. 10 is a graph showing a relation between rotational torque and a rotational speed by using a load resistance of sheets as a parameter when a speed limit is set in the separation roller.

FIG. 9 is a block diagram showing a control system for controlling an operation of the separation motor 19 which rotates the separation motor 26. FIG. 10 shows a relation between rotational torque and a rotational speed with a load resistance of a sheet P of a processing target set as a parameter when a speed limit is set in the separation motor 19. FIG. 11 shows a relation between rotational torque and a rotational speed in a conventional device having no speed limit set in a separation motor 19 with a load resistance of a sheet P of a processing target set as a parameter for comparison.

In actual rotation control, the control section 100 first monitors rotational torque $\tau$ of the separation roller 26, controls a current value to set the rotational torque $\tau$ to predetermined target torque $\tau_d$ (certain torque), and controls driving torque $\tau$ of the separation motor 19 (first control). Then, the control section 100 monitors a rotational speed $\omega$ of the separation roller 26, controls a current value to prevent the rotational speed $\omega$ from exceeding a present limit speed $\omega_0$, and imposes a limit on the rotational speed $\omega$ of the separation motor 19 (second control). In other words, in this case, the second control takes precedence over the first control. The control section 100 compares an actual rotational speed $\omega$ of the separation roller 26 with the limit speed $\omega_0$. The control section 100 makes no changes in the case of $\omega \leqq \omega_0$, but controls a current value supplied to the separation motor 19 to adjust (reduce) driving torque $\tau$ in the case of $\omega > \omega_0$.

When only torque control (first control) of the separation roller 26 is executed as in the conventional case, the separation motor 19 is controlled to output target torque $\tau_d$ preset in the driver of the separation motor 19. Accordingly, the rotational speed of the separation motor 19 is not managed. When a load resistance is smaller with respect to a designated torque value (e.g., thin or light sheet), the rotational speed of the separation motor 19 is increased to a highest speed (FIG. 11). In this case, when the thin sheet P of a small load resistance is separated, the separation roller 26 is rotated in a direction for returning the sheet P at an excessive speed, causing a bending problem of the sheet P.

When a speed limit is imposed on torque control (second control) (FIG. 10) as in the case of the first control method, a rotational speed is limited for a sheet of a small load resistance while there is no influence on a sheet of a large resistance (e.g., thick or heavy sheet). Thus, the separation roller 26 is operated at a rotational speed set equal to or less than a limit speed while certain rotational torque is maintained. Separation performance is exhibited for the thick sheet as conventionally, and the thin sheet can be stably separated without being bent by limiting the rotational speed of the separation roller 26.

Next, a second control method will be described.

Figure 12:
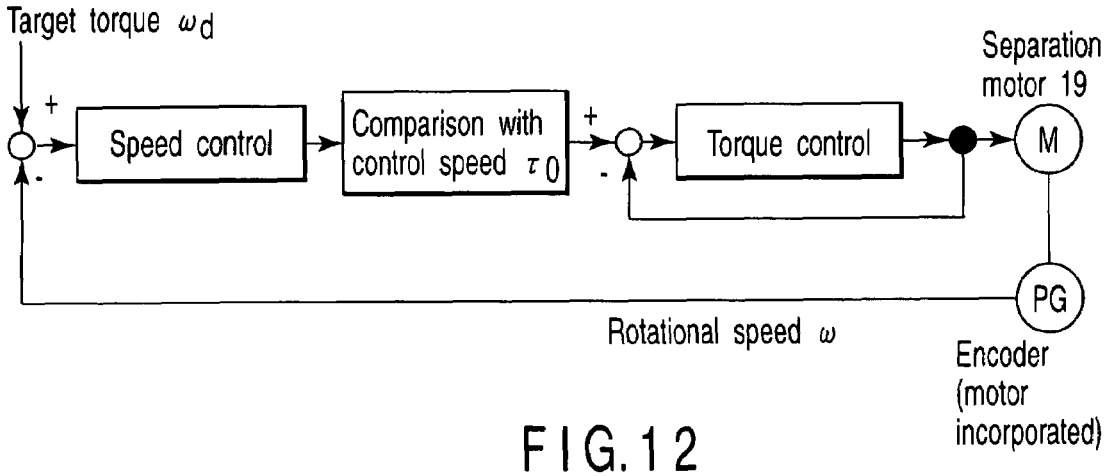
FIG. 12 is a block diagram showing a control system for controlling an operation based on a second control method of the separation roller during separation of the stack-fed sheets.
Figure 14:
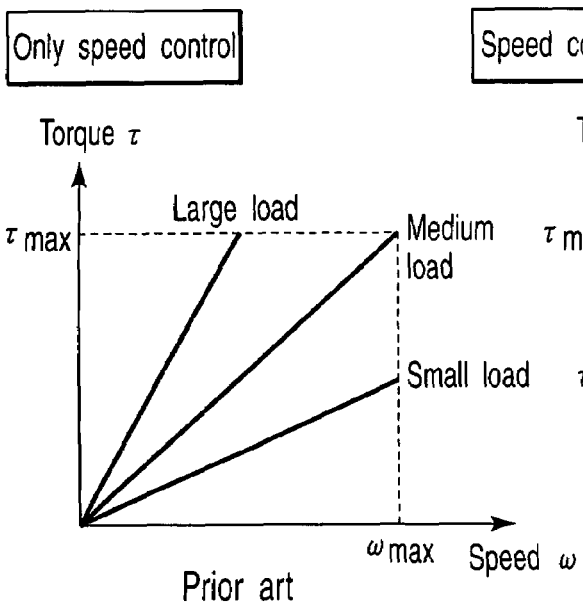
FIG. 14 is a graph showing a relation between a rotational speed and rotational torque by using the load resistance of the sheets as a parameter when no torque limit is set in the separation roller for comparison.
Figure 13:
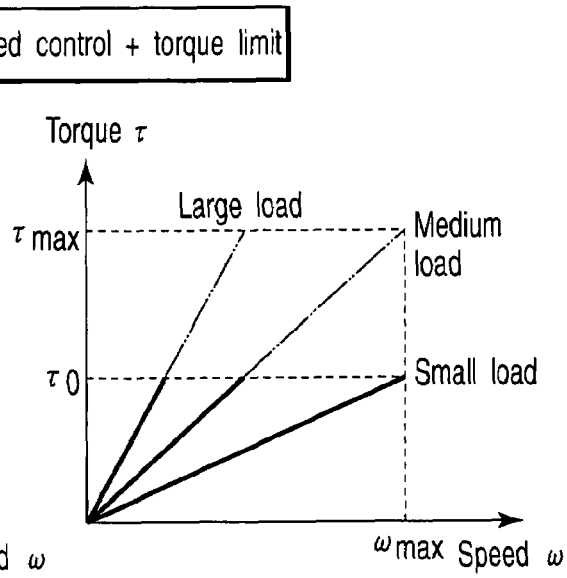
FIG. 13 is a graph showing a relation between a rotational speed and rotational torque by using the load resistance of the sheets as a parameter when a torque limit is set in the separation roller.

FIG. 12 is a block diagram showing a control system for realizing the control method. FIG. 13 shows a relation between a rotational speed and rotational torque with a load resistance of a sheet P of a processing target set as a parameter when a torque limit is set in the separation motor 19. FIG. 14 shows a relation between a rotational speed and rotational torque in a conventional device having no torque limit set in a separation motor 19 with a load resistance of a sheet P of a processing target set as a parameter for comparison.

In actual rotation control, the control section 100 first monitors a rotational speed $\omega$ of the separation roller 26, controls a current value to set the rotational speed $\omega$ to a predetermined target speed $\omega_d$ (certain speed), and controls a rotational speed $\omega$ of the separation motor 19 (first control). Then, the control section 100 monitors rotational torque $\tau$ of the separation roller 26, controls a current value to prevent the rotational torque $\tau$ from exceeding present limit torque $\tau_0$, and imposes a limit on the rotational torque $\tau$ of the separation motor 19 (second control). In other words, in this case, the second control takes precedence over the first control. The control section 100 compares actual rotational torque $\tau$ of the separation roller 26 with the limit torque $\tau_0$. The control section 100 makes no changes in the case of $\tau \leqq \tau_0$, but controls a current value supplied to the separation motor 19 to adjust (reduce) driving torque $\tau$ in the case of $\tau > \tau_0$.

When only speed control (first control) of the separation roller 26 is executed as in the conventional case, the separation motor 19 is controlled to a target speed $\tau$ preset in the driver of the separation motor 19. Accordingly, there is a possibility that driving torque of the separation motor 19 will be increased to maximum torque. To separate the stack-fed sheets well by the separation mechanism 15, rotational torque applied to the sheets P by the separation roller 26 must be smaller than torque applied to the sheets P by the takeout belt 6. If a separation force generated by the separation roller 26 becomes excessively large, a separation operation becomes impossible. In other words, as a conveying (feeding) operation is inadequate while a separation (returning) operation can be carried out, it is impossible to carry out a stable separation conveying operation.

On the other hand, when a torque limit is imposed on speed control (second control) as in the case of the second control method, the separation roller 26 can generate excessive separation force to enable a stable separation conveying operation. As the rotational torque depends on a size of a load resistance of a sheet P of a processing target while the rotational speed of the separation roller 26 is controlled to be almost constant, it is possible to carry out a separation operation without applying excessive driving torque to the sheet of a small load resistance.

As described above, during the separation operation of the stack-fed sheets, by limiting the rotational torque or the rotational speed of the separation roller 26, it is possible to carry out proper driving control in accordance with the rotational speed of the separation roller 26, and to apply an always proper separation force to all the sheets irrespective of load resistances from the sheets. In other words, by limiting the rotational speed of the separation roller 26, it is possible to prevent the rotational speed of the separation roller 26 from becoming excessively large when a sheet of a relatively small load is separated while certain rotational torque is applied to the separation roller 26, and to surely and stably separate the stack-fed sheets. Moreover, by limiting the rotational torque of the separation roller 26, it is possible to prevent the rotational torque of the separation roller 26 from becoming excessively large when a sheet of a relatively small load is separated while the separation roller 26 is rotated at a certain rotational speed, and to surely and stably separate the stack-fed sheets.

Figure 15:
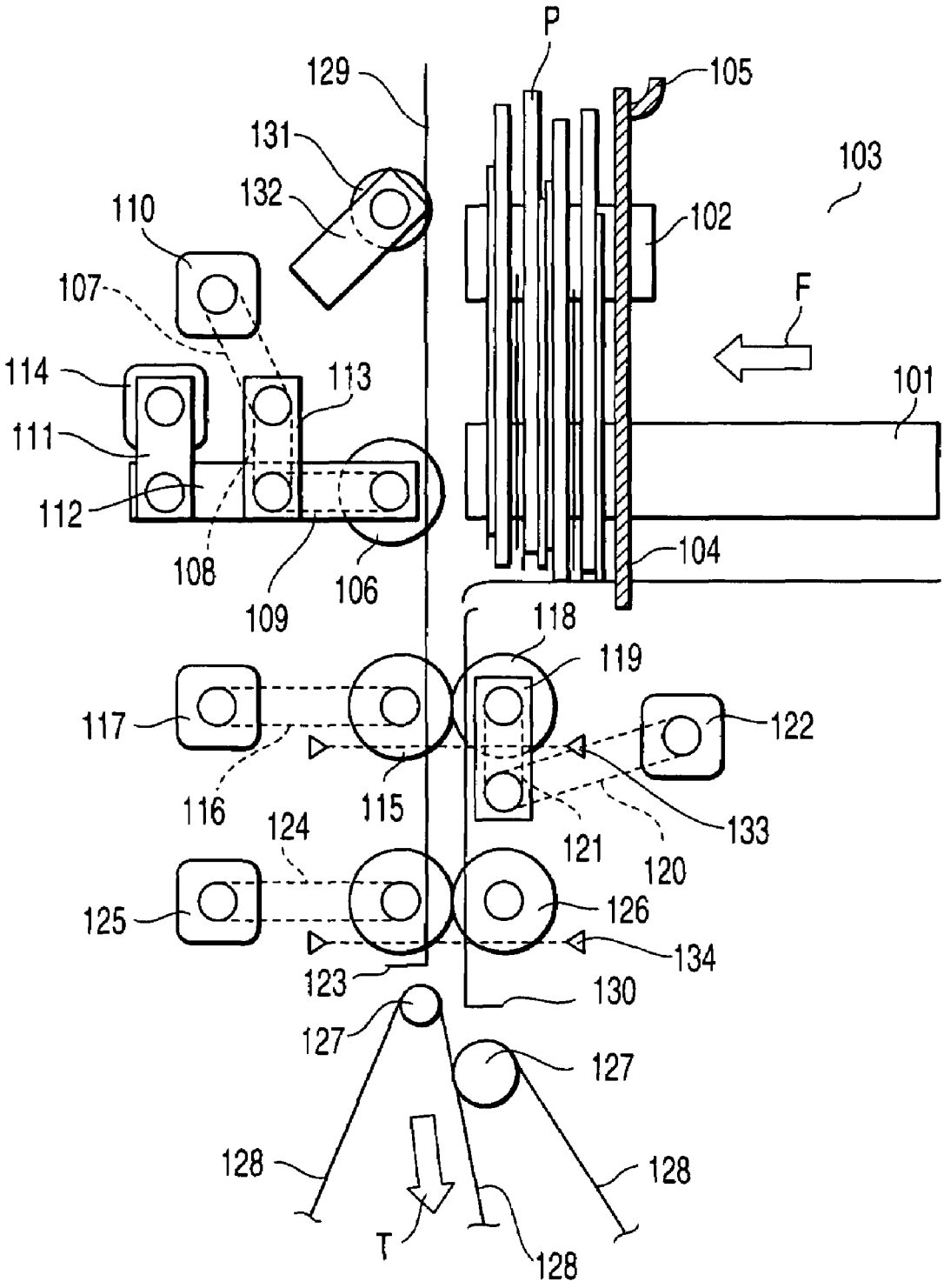
FIG. 15 is a plan diagram showing a schematic structure of a sheet takeout device according to a second embodiment of the present invention.
Figure 16:
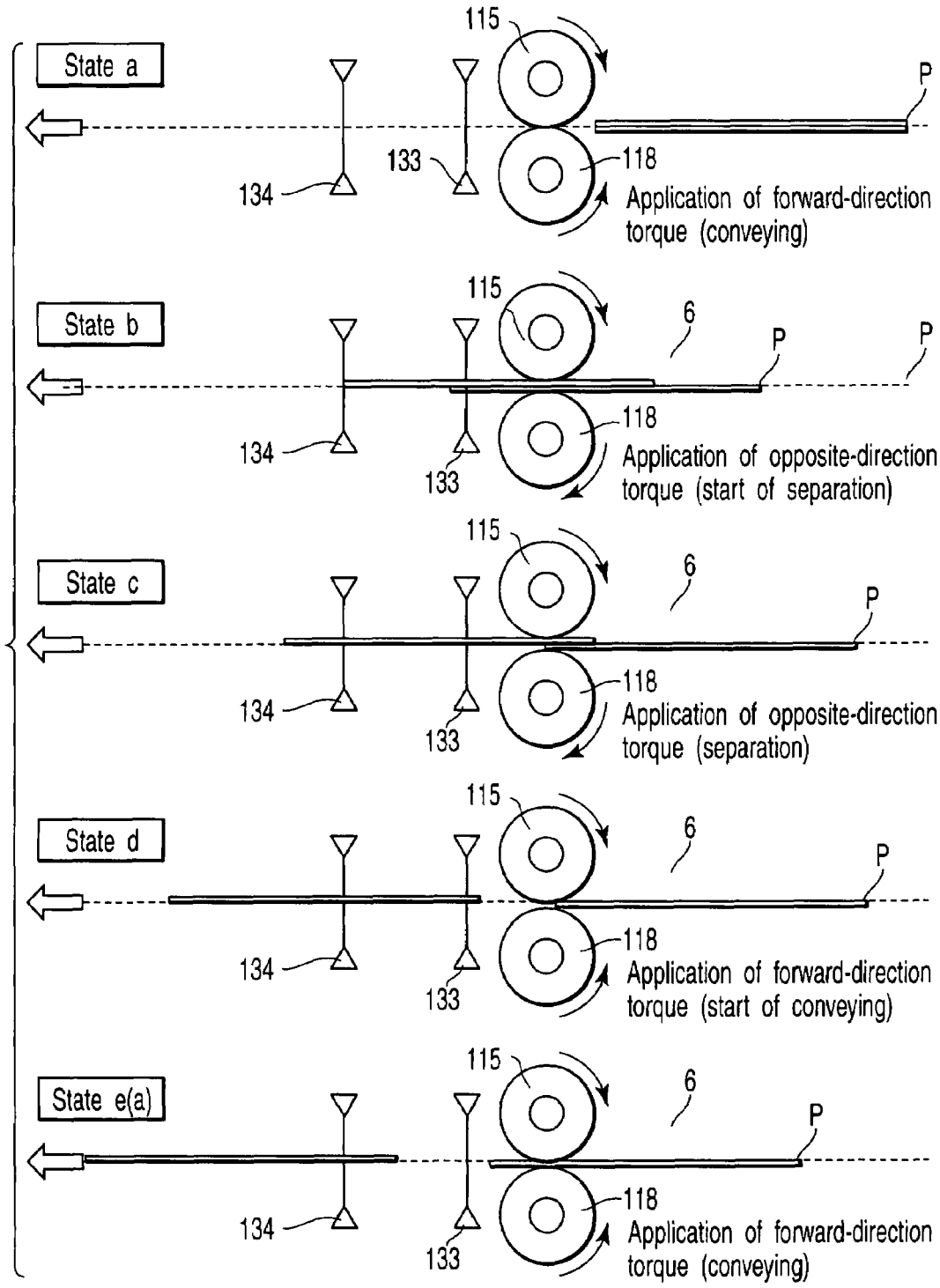
FIG. 16 is an operation explanatory diagram showing an operation of the sheet takeout device of FIG. 15.
Figure 17:
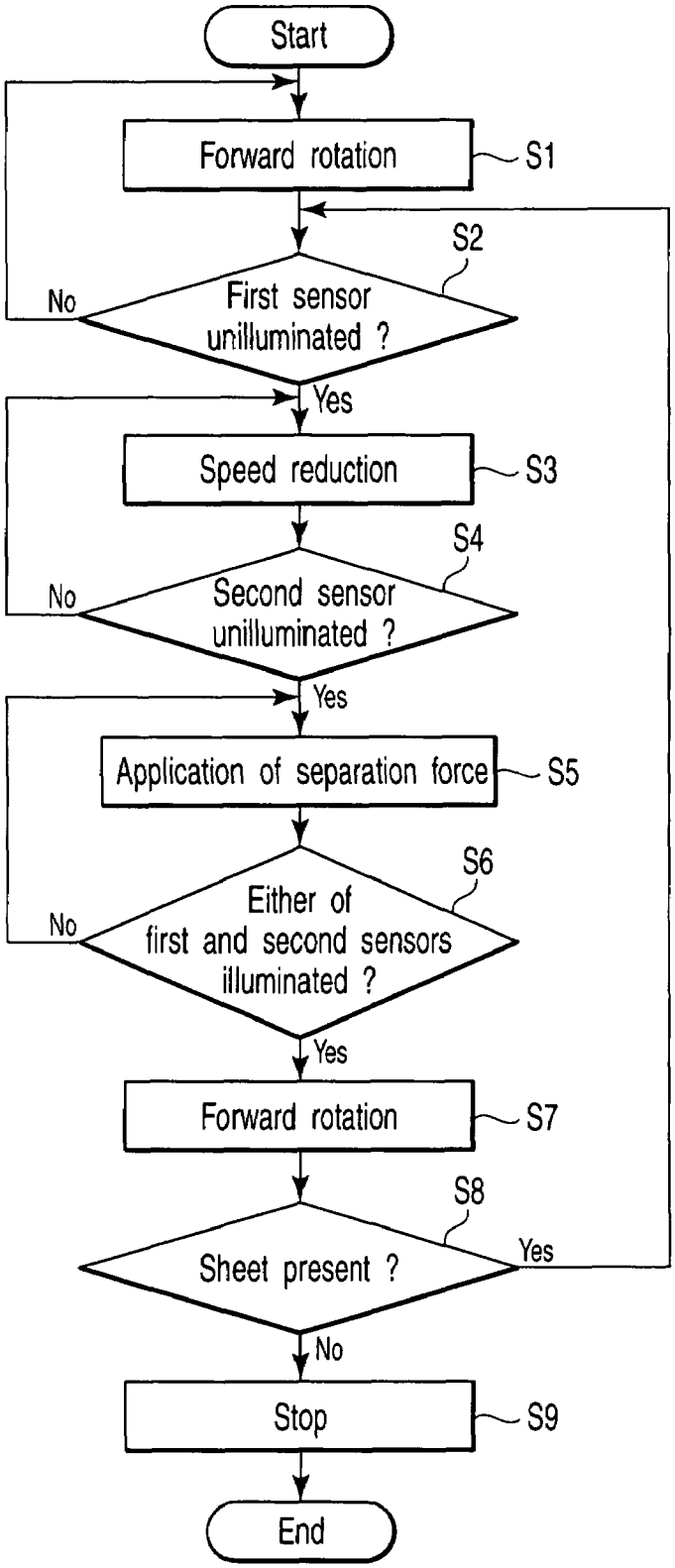
FIG. 17 is a flowchart showing the operation of the sheet takeout device of FIG. 15.

Next, a sheet takeout device (simply takeout device hereinafter) according to a second embodiment of the present invention will be described by referring to FIGS. 15 to 17. FIG. 15 is a plan diagram showing a configuration of main sections of the takeout device, FIG. 16 is an operation explanatory diagram showing an operation of the takeout device, and FIG. 17 is a flowchart showing an operation of the takeout device.

As shown in FIG. 15, as in the case of the takeout device of the first embodiment, the takeout device of this embodiment includes two floor belts 101, 102 exposed in a mounting base 103, and a backup plate 105 connected to the first floor belt 101. A moving-direction leading end sheet P (left end shown) is arranged in a takeout position by setting a plurality of sheets P upright in the floor belts 101, 102 of the mounting base 103, and moving the floor belts 101, 102 and the backup plate 105 in a direction of an arrow F (shown).

A delivery roller 106 is disposed in a position facing the takeout position of the sheets P. The delivery roller 106 is fixed to a rotary shaft via a one-way clutch (not shown). Accordingly, the delivery roller 106 can be freely rotated in a conveying direction (direction of an arrow T shown) of the sheets P, and resistance is reduced when the sheets P are pulled off.

A delivery motor 110 is connected to the delivery roller 106 via first to third timing belts 107 to 109. The delivery roller 106 driven by the delivery roller 110 is rotated to deliver the sheets P to a conveying-direction downstream side.

The delivery roller 106 is pressed to the sheets P by a predetermined pressing force via first to third delivery arms 111 to 113. The first to third delivery arms 111 to 113 constitute a parallel link mechanism, and regulate a swinging direction of the delivery roller 106 almost in a stacking direction of the sheets P.

A delivery arm motor 114 is connected to the first delivery arm 111 to drive the same. A servo motor of torque control is used for the delivery arm motor 114, and certain torque is output to maintain a pressing force of the delivery roller 106 to the sheets P almost constant.

A feed roller 115 is disposed on a conveying-direction downstream side of the delivery roller 106. A rotary shaft is fixed to the feed roller 115 via a one-way clutch (not shown), and a feed motor 117 is connected thereto via a timing belt 116. The feed roller 115 rotated by the feed motor 117 is rotated to convey the sheets P in the arrow direction T.

A separation roller 118 is disposed in a position facing the feed roller 115 by sandwiching a conveying path of the sheets P. According to the embodiment, the separation roller 118 is a friction roller whose peripheral surface is made of an elastic body such as rubber. The separation roller 118 is pressed to the feed roller 115 by a predetermined pressing force via a separation arm 119. A separation motor 122 is connected to the separation roller 118 via first and second timing belts 120 and 121. A servo motor is used for the separation motor 120, and it can be rotated in a forward/backward direction variably and by variable torque.

A pullout roller 123 is disposed on a conveying-direction downstream side of the feed roller 15. A pullout motor 125 is connected to the pullout roller 123 via a timing belt 124. A rotatable pinch roller 126 is pressed to the pull-put roller 123 by a predetermined pressing force sandwiching the conveying path.

A belt conveyor mechanism having two conveyor belts 128 wound on a plurality of rollers 127 to be set is disposed on a conveying-direction downstream side of the pullout roller 123. This belt conveyor mechanism receives the sheets P conveyed via the feed roller 115 and the pullout roller 123 in a nip to hold them, and pulls the sheets P out to further convey them to the downstream side.

Additionally, guides 129, 130 are disposed along the conveying path of the sheets P, and the conveying path of the sheets P is almost regulated therebetween. A support roller 131 is disposed in a conveying-direction upstream side of the delivery roller 106. The support roller 131 is pressed to the sheets P of the takeout position by a predetermined pressing force via a support arm 132, and functions to prevent falling of the sheets P supplied to the takeout position.

First and second sensors 133, 134 for detecting passage of conveying-direction leading and tail ends of the sheets P are disposed in the conveying path of the sheets P. The first sensor 133 is disposed in a position near the nip between the feed roller 115 and the separation roller 118 and slight shifted to the conveying-direction downstream side to detect passage of the leading and tail ends of the sheets P. The second sensor 134 is similarly disposed near the nip between the pullout roller 123 and the pullout pinch roller 126 to detect passage of the leading and tail ends of the sheets P. Transmission photoelectric sensors are used for the first and second sensors 133 and 134, and passage information of the sheets P is transmitted to the control section 100 (not shown) in this case.

Accordingly, the sheets P set upright in the mounting base 103 are supplied in an arrow direction F toward the delivery roller 106 via the first and second floor belts 101, 102 and the backup plate 105, and a stacking-direction leading-end sheet P is arranged in the takeout position. The sheet P supplied to the takeout position is brought into contact with the delivery roller 106 rotated in the conveying direction to be delivered to the conveying path by its rotation.

The sheet P taken out to the conveying path is conveyed more downstream by the feed roller 115, and pulled out by the pullout roller 123. At this time, stack-fed sheets P are separated by an opposite-direction separation force applied via the separation roller 118. The separated sheets P are conveyed further to the pullout roller 123 of the downstream side, and conveyed to a processing section (not shown) of the downstream side by the conveyor belt 128 of the downstream side.

An operation of the takeout device of the aforementioned structure, especially an operation of the separation roller 18, will be described below by referring to FIGS. 16 and 17.

First, as an initializing operation of the device, the two floor belts 101, 102 are run to supply a supply-direction leading-end sheet P to the takeout position. Then, the delivery roller 106 is rotated forward at a tangential speed V1, the feed roller 115 is rotated forward at a tangential speed V2, the pullout roller 123 is rotated forward at a tangential speed V3, and the conveyor belt 128 is run at a tangential speed V4. According to the embodiment, the tangential velocities V1 to V4 are set to satisfy a relation of $V1 \leqq V2 \leqq V3 = V4$. By this setting, the sheets P are conveyed while being drawn out to enable prevention of wrinkles. A gap can be formed between the sheets by a speed difference.

In this state, delivery of the sheets P is started. At this time, the separation roller 118 is rotated forward at the same tangential speed (V2) as that of the feed roller 15 (FIG. 17, step S1). In other words, the sheet P of the takeout position is generally delivered at a speed V1 by rotation of the delivery roller 106, pulled out from the nip between the feed roller 115 and the separation roller 118 rotated at the same tangential speed (V2) in the same direction (forward direction), pulled out from the nip between the pullout roller 123 and the pinch roller 126 rotated at a higher speed (V3), and transferred to the conveyor belt 128 to be conveyed to a subsequent processing section (not shown).

For example, as shown in a state A of FIG. 16, presuming that two stacked sheets P are taken out to the conveying path, the control section 100 of the takeout device reduces a forward rotation speed of the separation roller 118 (step S3) by using detection of a leading end of the sheets P at the first sensor 133 as a trigger (step S21; YES), and generates a speed difference between a first sheet P conveyed by the feed roller 115 and a second sheet P conveyed by the separation roller 118. Accordingly, the two stacked sheets P are slightly shifted in a venetian-blind configuration so that the first sheet can precede.

Subsequently, as shown in a state b of FIG. 16, upon detection of the leading end of the first sheet P shifted in the venetian-blind configuration by the second sensor 134 (step S4; YES), the control section 100 applies an opposite-direction separation force to the second sheet P via the separation roller 118 (step S5). Accordingly, the first sheet P is pulled out by the pullout roller 123, the second sheet P is returned in an opposite direction by the separation roller 118, and the two sheets P are pulled apart from each other in the opposing directions. At this time, ideally, as shown in a state c of FIG. 16, the leading ends of the two sheets P are returned to the nip position between the feed roller 115 and the separation roller 118.

A separation force generated by the opposite-direction separation force is set weaker than a conveying force generated by sandwiching between the pullout roller 123 of the downstream side and the pullout pinch roller 126. Thus, for example, when the number of sheets P to be conveyed is one (not stack-fed), the leading end of the sheet P is held by the nip between the pullout roller 123 and the pullout pinch 126 to be conveyed, and the separation force never blocks conveying of the sheet P.

Subsequently, as shown in a state d of FIG. 16, upon detection of tail end passage of the first sheet P at the first sensor 133 (step S6; YES), the control section 100 rotates the separation roller 118 forward again (step S7), and conveys the second sheet P in a forward direction as shown in a state e of FIG. 16. Then, if presence of a sheet P to be taken out next in the mounting base 103 is determined (step S8; YES), the control section 100 returns to the step S2 to continue the processing. If it is determined that there is no sheet P to be taken out next (step S8; NO), the control section 100 stops the device (step S9) to finish the processing.

According to the embodiment, as in the case of the first embodiment, the separation force is applied via the separation roller 118 under the condition that the leading end of the sheet P taken out from the mounting base 103 is held by the pullout roller 123. Thus, even when a relatively inflexible and thin sheet P or a sheet folded into two is taken out, it is possible to prevent bending of the sheet P in a Z shape between the separation roller 118 rotated backward and the delivery roller 106, enabling a stable separation conveying operation. By adding a conveying function to the separation roller 18 which originally has a separation function alone, it is possible to assist a conveying force of the feed roller 115 of the opposite side, which is advantageous for processing a heavy medium.

When an opposite-direction separation force is always applied to the separation roller 118 as conventionally, the separation roller 118 must be rotated associatively with the feed roller 115 in a state in which no sheet P is conveyed and in a state in which one sheet P is conveyed. Accordingly, a friction coefficient between the rubber rollers must be set relatively high. On the other hand, according to the embodiment, by rotating and controlling the separation roller 118 to apply a separation force in a state in which the leading end of the preceding sheet P is held by the pullout roller 123, the necessity of rotating the separation roller 118 associatively with the feed roller 115 while applying the separation force under the aforementioned condition is eliminated, and it is only necessary to satisfy a relation of "friction coefficient between rubber roller and sheet">"friction coefficient between sheets".

According to the embodiment, when the separation force is applied to the stack-fed sheets as shown in the states a and c of FIG. 16, the separation roller 118 may be driven and controlled as in the case of the first embodiment. In other words, by imposing a limit on the rotational speed or the rotational torque of the separation roller 118 during separation, a proper separation force can be applied irrespective of load resistances of sheets, and the stack-fed sheets can be surely and stably separated.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

For example, according to the second embodiment, as in the case of the first embodiment, a plurality of detection means for detecting passage of the sheets P may be disposed on a conveying-direction upstream side of the second detection means 134.

According to the first embodiment, the separation roller 26 is disposed in the position facing the takeout belt 6 by sandwiching the conveying path. However, a configuration may be employed in which one conveyor belt (left side of FIG. 1) of the belt conveyor mechanism 21 is extended to the position facing the separation roller 26.

What is claimed is:

1. A sheet takeout device comprising:

a takeout section rotated in contact with a sheet to take out the sheet in a surface direction;

a conveying section, that is configured to hold the sheet taken out by the takeout section and to further convey the sheet;

a detection section which detects the holding of the sheet taken out by the takeout section in the conveying section; and a separation section, that includes a separation roller, and is disposed on a side opposite to the takeout section across a conveying path between the takeout section and the conveying section, the separation section configured to apply an opposite-direction separation force to second and following sheets associatively taken out by the sheet taken out by the takeout section, after the sheet taken out by the takeout section is transferred to the conveying section.

2. The device according to claim 1, wherein the separation roller is rotated in a forward direction until the sheet taken out by the takeout section is transferred to the conveying section.

3. The device according to claim 2, wherein the separation roller is rotated in the forward direction at a speed substantially equal to that of the takeout section in a standby state, and the speed is gradually reduced until the taken-out sheet is transferred to the conveying section.

4. The device according to claim 2, wherein the separation roller is rotated again in the forward direction, after a gap between the sheet transferred to the conveying section and a subsequent sheet is detected.

5. The device according to claim 1, further comprising a driving section which applies a driving force for generating the separation force to the separation section, wherein the separation force applied by the separation roller is set to a force weaker than a conveying force of the conveying section.

6. The device according to claim 2, wherein a rotational speed at which the separation roller is rotated in the forward direction is set to a speed not exceeding a conveying speed of the conveying section.

7. The device according to claim 1, further comprising:

a driving section which applies a driving force for generating the separation force to the separation section; and a control section which controls the driving section to change the driving force in accordance with an operation state of the separation section.

8. the device according to claim 7, wherein the control section monitors a rotational speed of the separation roller, and controls the driving section to prevent the rotational speed from exceeding a certain speed.

9. The device according to claim 7, wherein the control section monitors rotational torque of the separation roller, and controls the driving section to prevent the rotational torque from exceeding certain torque.

10. The device according to claim 7, wherein the control section monitors the rotational speed and the rotational torque of the separation roller and controls the driving section to prevent the rotational speed and the rotation torque from exceeding a certain rotational speed and certain rotational torque.

11. A sheet takeout device comprising:

an insertion section which inserts a plurality of sheets in a stacked manner;

a feed section which moves the sheets inserted via the insertion section in a stacking direction to feed a leading-end sheet of a moving direction to feed the sheet to a takeout position;

a takeout section brought into contact with the sheet fed to the takeout position by the feed section, and rotated in a first direction substantially orthogonal to the stacking direction to take out the sheet in the first direction;

a conveying section which receives the sheet taken out by the takeout section on a downstream side of the first direction of the takeout section, and holds the sheet to further convey the sheet in the first direction;

a separation section, that includes a separation roller, and is configured to apply a separation force of a second direction reverse to the first direction to the sheet taken out in the first direction by the takeout section from a side opposite to the side contacted by the takeout section to separate second and following sheets associatively taken out with the sheet;

a detection section which detects the holding of the sheet taken out by the takeout section in the conveying section; and a control section which controls the separation section to apply the separation force after the detection section detects the holding of the sheet taken out by the takeout section in the conveying section.

12. The device according to claim 11, wherein the control section rotates the separation roller in the first direction until the detection section detects the holding of the sheet taken out by the takeout section in the conveying section.

13. The device according to claim 12, wherein the control section rotates the separation roller in the first direction at a speed substantially equal to that of the takeout section in a standby state before the takeout section takes out the sheet and gradually reduces a rotational speed of the separation roller until the detection section detects the holding of the sheet taken out by the takeout section in the conveying section.

14. The device according to claim 12, further comprising:

a gap detection section which detects passage, in the first direction, of a tail end of the sheet transferred to the conveying section to be conveyed on a downstream side of the separation roller of the first direction, and a gap between the sheet and a subsequent sheet, wherein the control section rotates the separation roller again in the first direction when the gap detection section detects the gap while the separation force is applied via the separation section.

15. The device according to claim 11, further comprising a driving section which applies a driving force for generating the separation force to the separation section, wherein the separation force applied by the separation roller is set to a force weaker than a conveying force of the conveying section.

16. The device according to claim 12, wherein the rotational speed of the separation roller in the first direction is set to a speed not exceeding a conveying speed of the conveying section.

17. The device according to claim 11, wherein the separation roller has a peripheral surface made of a rigid body, and includes an adsorption roller rotated while negative pressure is generated in the peripheral surface to adsorb the sheet.

18. The device according to claim 11, further comprising:

a driving section which applies a driving force for generating the separation force to the separation section, wherein the control section monitors an operation state of the separation section while, the separation force is applied via the separation section, and controls the driving section to change the driving force for driving the separation section in accordance with the operation state.

19. The device according to claim 18, wherein the control section monitors a rotational speed of the separation roller, and controls the driving section to prevent the rotational speed from exceeding a certain speed.

20. The device according to claim 18, wherein the control section monitors rotational torque of the separation roller, and controls the driving section to prevent the rotational torque from exceeding certain torque.

21. The device according to claim 18, wherein the control section monitors a rotational speed and rotational torque of the separation roller and controls the driving section to prevent the rotational speed and the rotational torque from exceeding a certain speed and certain torque.

22. A sheet takeout method comprising:

taking out stacked sheets one by one to a conveying path;

holding the sheets taken out to the conveying path to further convey the sheets; and separating sheets by applying an opposite-direction separation force to second and following sheets associatively taken out, after the sheet taken out is transferred to the conveying path.

23. The method according to claim 22, wherein the separation force applied to the second and following sheets is set to a force weaker than a conveying force of the sheets during conveying of the sheets.

24. The method according to claim 22, wherein during the separating of the sheets, a separation roller is brought into contact with the second and following sheets to apply the separation force, and a driving force is variably controlled to prevent a rotational speed of the separation roller from exceeding a certain speed.

25. The method according to claim 22, wherein during the separating of the sheets, a separation roller is brought into contact with the second and following sheets to apply the separation force, and a driving force is variably controlled to prevent rotational torque of the separation roller from exceeding certain torque.

26. The method according to claim 22, wherein during the separating of the sheets, a separation roller is brought into contact with the second and following sheet to apply the separation force, and a driving force is variably controlled to prevent a rotational speed and rotation torque of the separation roller from exceeding a certain speed and certain torque.

* * * * *